US008418352B2

(12) United States Patent
Wu et al.

(10) Patent No.: US 8,418,352 B2
(45) Date of Patent: Apr. 16, 2013

(54) MULTI-CURVATURE ANTENNA AND METHOD FOR FABRICATING THE SAME

(75) Inventors: Pei-Feng Wu, Taipei County (TW); Tsung-Wen Chiu, Taipei County (TW); Fu-Ren Hsiao, Taipei County (TW)

(73) Assignee: Advanced Connectek, Inc., Taipei (TW)

( * ) Notice: Subject to any disclaimer, the term of this patent is extended or adjusted under 35 U.S.C. 154(b) by 697 days.

(21) Appl. No.: 12/639,268

(22) Filed: Dec. 16, 2009

(65) Prior Publication Data

US 2010/0283686 A1 Nov. 11, 2010

(30) Foreign Application Priority Data

May 8, 2009 (TW) ..... 98115241 A

(51) Int. Cl.
*H01Q 13/00* (2006.01)
*H01Q 1/38* (2006.01)

(52) U.S. Cl.
USPC ..... 29/600; 343/700 MS

(58) Field of Classification Search ..... 343/700 MS, 343/702; 29/600
See application file for complete search history.

(56) References Cited

U.S. PATENT DOCUMENTS 5,614,915 A * 3/1997 Webb ..... 343/770
6,133,883 A * 10/2000 Munson et al. ..... 343/700 MS
6,239,766 B1 * 5/2001 Smith et al. ..... 343/841

* cited by examiner

*Primary Examiner* — Tan Ho
(74) *Attorney, Agent, or Firm* — Schmeiser, Olsen & Watts LLP

(57) ABSTRACT

A multi-curvature antenna comprises a radiation conductor and a support element. The outer rim of the radiation conductor is fabricated into an outer ring having an arc-shape surface, and the arc-shape surface has a notch. The central portion of the radiation conductor is patterned to form a conduction path. The support element carries the radiation conductor. A method for fabricating a multi-curvature antenna comprises providing a plane metallic sheet; pressing or stamping the metallic sheet to form a radiation conductor having an outer ring with an arc-shape surface; pattering the central portion of the radiation conductor into a predetermined conduction path and punching the outer ring to form a connection member; and cutting off the connection member to complete a multi-curvature antenna.

5 Claims, 4 Drawing Sheets

MULTI-CURVATURE ANTENNA AND METHOD FOR FABRICATING THE SAME

BACKGROUND OF THE INVENTION

1. Field of the Invention

The present invention relates to a multi-curvature antenna and a method for fabricating the same, particularly to an antenna with the outer ring of the radiation conductor having a multi-curvature arc-shape surface.

2. Description of the Related Art

The antenna is a gate where airwaves enter or leave a wireless communication device. Therefore, the antenna is an indispensable component for a wireless communication device. The standards of wireless communication have evolved from low frequency to high frequency. Simultaneously, the wireless communication devices have a trend toward miniature designs. For example, the external antenna of a mobile phone has been evolved into a compact and lightweight hidden antenna. As an antenna must be integrated with the inner structure of a mobile phone, the size, shape, radiation performance, transmission bandwidth and fabrication process of antennae are diversified and have high uncertainty. Especially, the fabrication process has a critical and substantial influence on the performance of an antenna.

The fabrication process of an antenna includes punching a metallic sheet, stamping the metallic sheet to pattern a radiation conductor, smoothing and trimming the radiation conductor, electroplating the radiation conductor, sticking the radiation conductor to a plastic component, etc. The related manufacturers have been devoted to the subjects of simplifying the fabrication process, upgrading the quality, promoting the yield rate.

SUMMARY OF THE INVENTION

The primary objective of the present invention is to provide a multi-curvature antenna and a method for fabricating the same to achieve a high-quality antenna and a simple and high-productivity fabrication process.

To achieve the abovementioned objective, the present invention proposes a multi-curvature antenna, which comprises a radiation conductor and a support element, wherein the outer rim of the radiation conductor is fabricated into an outer ring having an arc-shape surface, and wherein the arc-shape surface has a notch, and wherein the central portion of the radiation conductor is patterned to have a conduction path, and wherein the radiation conductor is stuck to the support element.

The present invention also proposes a method for fabricating a multi-curvature antenna, which comprises Step 1: providing a plane metallic sheet;

Step 2: pressing or stamping the metallic sheet to form a radiation conductor having an outer ring with an arc-shape surface;

Step 3: pattering the central portion of the radiation conductor into a predetermined conduction path and punching the outer ring to form a connection member; and Step 4: cutting off the connection member.

The method of the present invention shortens and simplifies the fabrication process effectively, benefits mass production and improves the reliability of quality. Therefore, the multi-curvature antenna and the method of the present invention can be applied to various specifications of wireless communication products.

Below, the preferred embodiments are described in detail to make easily understood the technical contents of the present invention.

DETAILED DESCRIPTION OF THE INVENTION

Figure 1:
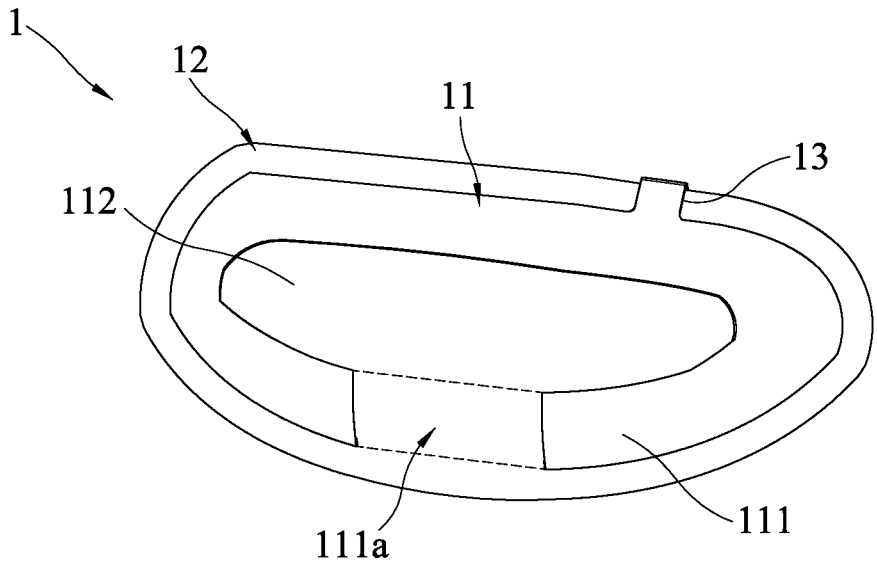
FIG. 1 is a perspective view of a multi-curvature antenna according to a first embodiment of the present invention.
Figure 2A:
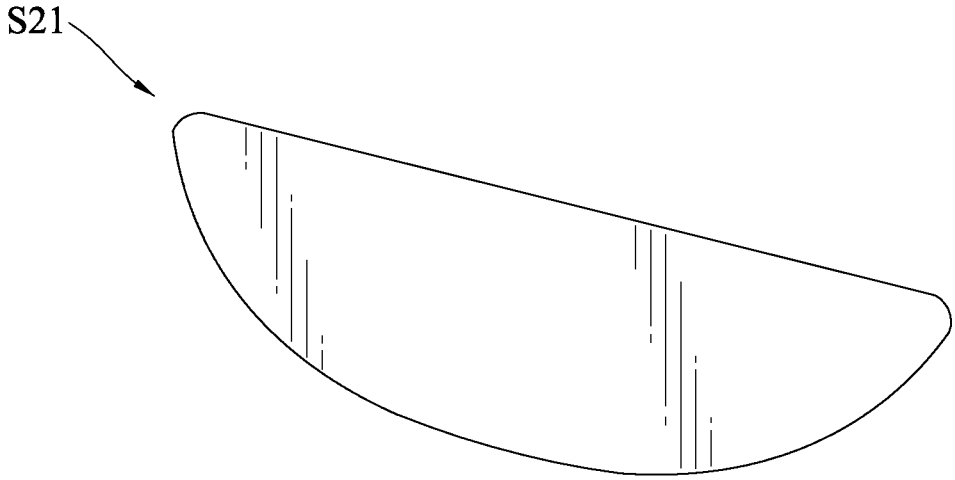
FIG. 2A is a diagram schematically showing a first step of a method for fabricating a multi-curvature antenna according to the first embodiment of the present invention.
Figure 2B:
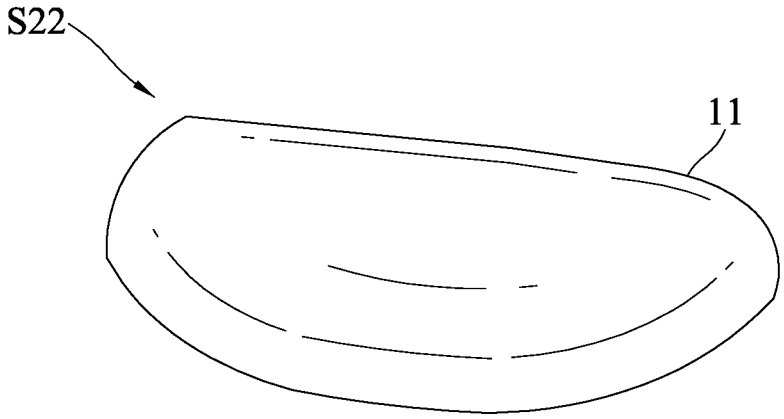
FIG. 2B is a diagram schematically showing a second step of a method for fabricating a multi-curvature antenna according to the first embodiment of the present invention.
Figure 2C:
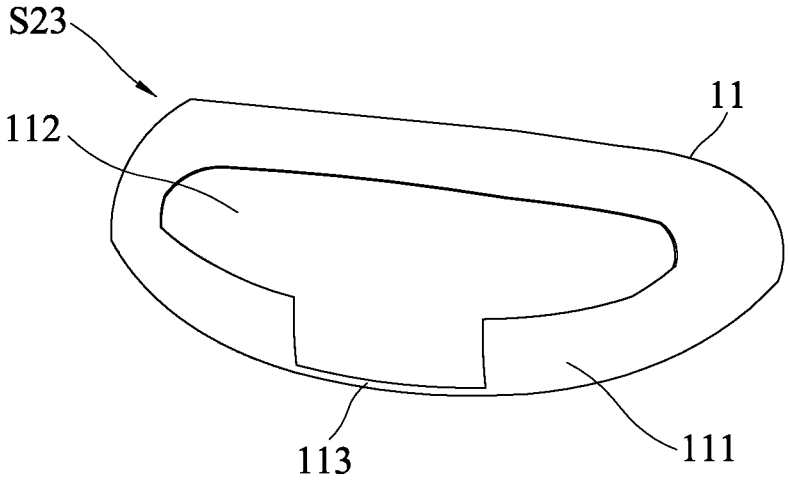
FIG. 2C is a diagram schematically showing a third step of a method for fabricating a multi-curvature antenna according to the first embodiment of the present invention.
Figure 2D:
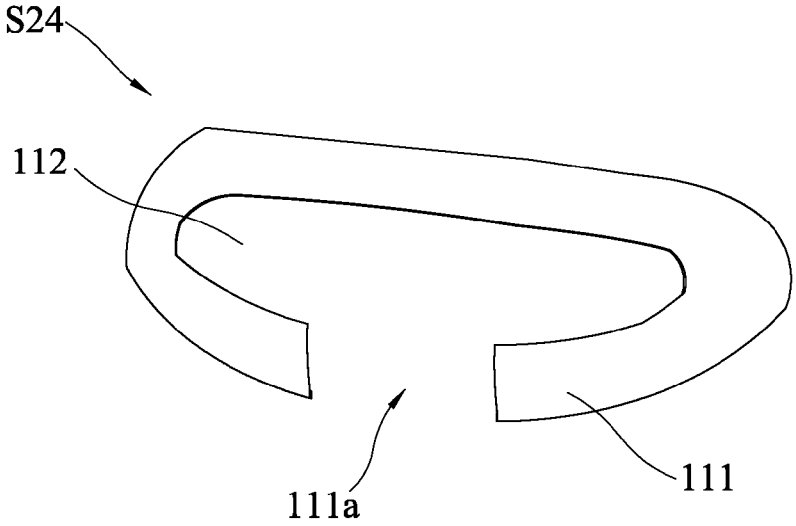
FIG. 2D is a diagram schematically showing a fourth step of a method for fabricating a multi-curvature antenna according to the first embodiment of the present invention.

Refer to FIG. 1 a perspective view of a multi-curvature antenna according to a first embodiment of the present invention. The multi-curvature antenna 1 of the present invention comprises a radiation conductor 11 and a support element 12. The outer rim of the radiation conductor 11 is fabricated into an outer ring 111 having an arc-shape surface, and the arc-shape surface has a notch 111*a*. The central portion 112 of the radiation conductor 11 is patterned to have a conduction path. The support element 12 carries the radiation conductor 11.

In the first embodiment, the multi-curvature antenna 1 is similar to a bowl-like hemisphere having a major axis of about 50 mm and a height of about 12 mm. The outer ring 111 has a length of about 75 mm and a height of about 12 mm. The notch 111*a* has a length of about 15 mm and a height of about 5 mm. The central portion 112 has a major axis of about 30 mm. The support element 12 is made of a plastic material and has dimensions approximate to those of the multi-curvature antenna 1. The radiation conductor 11 is stuck to the surface of the support element 12 and connected to a signal pin 13 where the high-frequency signal is fed. Different sections of the arc-shape surface of the outer ring 111 respectively have different curvatures, which may vary with the contour of the casing of the wireless communication device, whereby the radiation conductor 11 can be closely stuck to the support element 12.

Refer to FIGS. 2A-2D diagrams schematically showing a method for fabricating a multi-curvature antenna according to the first embodiment of the present invention. In Step S21, a plane metallic sheet is provided, and the plane metallic sheet may be a copper sheet. In Step S22, the metallic sheet is stamped to form a radiation conductor 11 having an outer ring 111 with an arc-shape surface. In Step S23, the central portion 112 of the radiation conductor 11 is patterned into a predetermined conduction path. In the first embodiment, the support element 12 is similar to a bowl-like hemisphere. Therefore, the pattern of the radiation conductor 11 is stamped to have a shape of an elliptic hemisphere. Further, the outer ring 111 is punched to form a connection member 113. In Step S24, the connection member 113 is cut off. Thus is completed the multi-curvature antenna 1.

Figure 3:
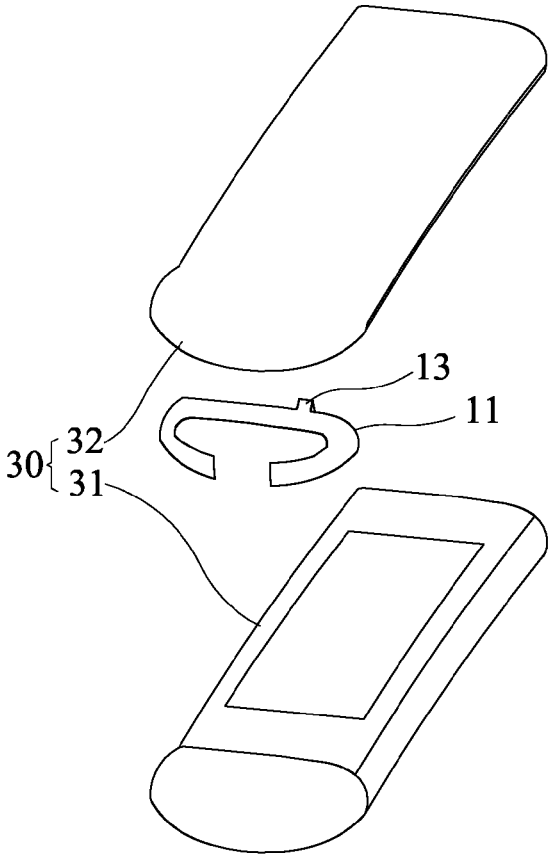
FIG. 3 is a perspective exploded view schematically showing that a mobile phone uses the multi-curvature antenna according to the first embodiment of the present invention.

Besides, the radiation conductor 11 may be electroplated with nickel to prevent the radiation conductor 11 from corrosion, Refer to FIG. 3 a perspective exploded view schematically showing that a mobile phone 3 uses the multi-curvature antenna according to the first embodiment of the present invention, wherein a cover 32 is separated from a phone body 31. After fabricated according to the method of the present invention, the multi-curvature antenna 1 is assembled to a support element 12 inside the mobile phone 3 and connected to a signal pin 13 where high-frequency signals are fed. Thereby, wireless signals can be received and transmitted.

In the present invention, different sections of the arc-shape surface of the outer ring 111 respectively have different curvatures varying with the contour of the casing of the wireless communication device. Therefore, the radiation conductor 11 can be closely stuck to the support element 12.

Figure 4:
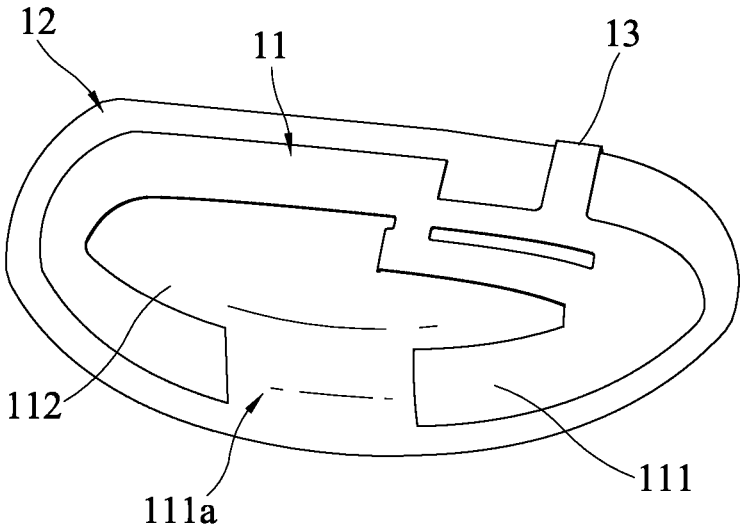
FIG. 4 is a perspective view of a multi-curvature antenna according to a second embodiment of the present invention.

Refer to FIG. 4 a perspective view of a multi-curvature antenna according to a second embodiment of the present invention. The second embodiment is basically similar to the first embodiment except the conduction path patterned in the central portion 112 of the radiation conductor 11 of the second embodiment is different from that of the first embodiment. Therefore, no matter what complexity the conduction path has, the method of the present invention can always readily fabricate the multi-curvature antenna.

From the above description, it is known that the present invention meets the conditions for a patent—utility, novelty and non-obviousness. However, the embodiments described above are only to exemplify the present invention but not to limit the scope of the present invention. Therefore, any equivalent modification or variation according to the spirit of the present invention is to be also included with the scope of the present invention.

What is claimed is:

1. A method for fabricating a multi-curvature antenna comprising providing a plane metallic sheet;

pressing or stamping said metallic sheet to form a radiation conductor having an outer ring with an arc-shape surface;

pattering a central portion of said radiation conductor into a predetermined conduction path and punching said outer ring to form a connection member; and cutting off said connection member to complete a multi-curvature antenna.

2. The method for fabricating a multi-curvature antenna according to claim 1, wherein said metallic sheet is made of copper.

3. The method for fabricating a multi-curvature antenna according to claim 1, wherein said radiation conductor is electroplated with nickel.

4. The method for fabricating a multi-curvature antenna according to claim 1, wherein different sections of said arc-shape surface of said outer ring respectively have different curvatures.

5. The method for fabricating a multi-curvature antenna according to claim 1, wherein said outer ring is connected to a signal pin.

* * * * *